US010655327B2

(12) United States Patent
Schurig

(10) Patent No.: US 10,655,327 B2
(45) Date of Patent: May 19, 2020

(54) WALL CONSTRUCTION SYSTEM WITH DRYWALL COMPOSITE COLUMNS AND METHOD FOR WALL CONSTRUCTION

(71) Applicant: Burkhart Schurig, Lampertswalde (DE)

(72) Inventor: Burkhart Schurig, Lampertswalde (DE)

( * ) Notice: Subject to any disclaimer, the term of this patent is extended or adjusted under 35 U.S.C. 154(b) by 0 days.

(21) Appl. No.: 16/342,190

(22) PCT Filed: Oct. 16, 2017

(86) PCT No.: PCT/DE2017/000354
§ 371 (c)(1),
(2) Date: Apr. 15, 2019

(87) PCT Pub. No.: WO2018/072777
PCT Pub. Date: Apr. 26, 2018

(65) Prior Publication Data

US 2019/0284802 A1 Sep. 19, 2019

(30) Foreign Application Priority Data

Oct. 17, 2016 (DE) ..... 10 2016 012 398

(51) Int. Cl.
*E04B 2/74* (2006.01)
*E04B 2/64* (2006.01)
(Continued)

(52) U.S. Cl.
CPC ..... *E04B 2/7453* (2013.01); *E04B 1/165* (2013.01); *E04B 2/64* (2013.01); *E04B 2/72* (2013.01);
(Continued)

(58) Field of Classification Search
CPC ..... E04B 2/64; E04B 2/7457; E04B 1/165; E04B 2/723; E04B 2/72; E04B 2/7453; E04B 2/721; E04C 3/34
See application file for complete search history.

(56) References Cited

U.S. PATENT DOCUMENTS 2,753,962 A * 7/1956 McBerty ..... E04B 2/68 52/93.1
3,355,852 A * 12/1967 Lally ..... E04B 1/943 52/834
(Continued)

FOREIGN PATENT DOCUMENTS

BE 634614 A 3/2010
DE 816143 C 10/1951
(Continued)

*Primary Examiner* — Jessie T Fonseca
(74) *Attorney, Agent, or Firm* — Smartpat PLC

(57) ABSTRACT

Disclosed are a wall construction system with drywall composite columns and a method for constructing walls using thin sheet steel sections in concrete composite construction for erecting story-high walls with at least one-sided planking with building boards, in particular for residential buildings. Structural loads of solid ceilings and facade walls are absorbed via the composite columns arranged in a modular grid within the wall plane. The joining of the composite columns takes place at the column head over a concrete beam on which the ceiling rests. In-filling wall or facade elements may be arranged between the composite columns. The composite columns include a concrete composite column with a sheet metal reinforcement and a spatially offset thin-walled sheet steel section for mounting drywall thereto even after the metal reinforcement has been filled with concrete. The sheet metal reinforcement and the thin-walled sheet steel section may have different material qualities and thicknesses.

15 Claims, 3 Drawing Sheets

(51) Int. Cl.
*E04B 2/72* (2006.01)
*E04C 3/34* (2006.01)
*E04B 1/16* (2006.01)

(52) U.S. Cl.
CPC ..... *E04B 2/721* (2013.01); *E04B 2/723* (2013.01); *E04B 2/7457* (2013.01); *E04C 3/34* (2013.01)

(56) References Cited

U.S. PATENT DOCUMENTS 4,120,131 A 10/1978 Carroll
4,484,427 A * 11/1984 Crites ..... E04F 13/0733 52/261
4,541,219 A * 9/1985 Parker ..... E04F 13/0837 403/231
4,841,707 A * 6/1989 Novoa ..... E04B 2/66 52/275
4,905,440 A * 3/1990 Schilger ..... E04C 3/293 52/368
2004/0068948 A1 4/2004 Wrass
2007/0193143 A1 * 8/2007 Antonic ..... E06B 3/6621 52/241
2015/0204067 A1 7/2015 Binder et al.

FOREIGN PATENT DOCUMENTS

DE 4343465 A1 6/1995
DE 102005026797 A1 12/2006
EP 2360321 A2 8/2011
FR 900328 A 6/1945
JP 2012140824 A 7/2012
WO 0017461 A1 3/2000
WO 0250383 A1 6/2002
WO 2014005162 A1 1/2014

* cited by examiner

WALL CONSTRUCTION SYSTEM WITH DRYWALL COMPOSITE COLUMNS AND METHOD FOR WALL CONSTRUCTION

TECHNICAL FIELD

The invention relates to a wall construction system with drywall composite columns. The invention further relates to a method for constructing walls using thin sheet steel sections in concrete composite construction for erecting story-high walls with at least one-sided planking with building boards, in particular for residential buildings.

BACKGROUND

Composite columns have been used for a long time, in particular in form of concrete-filled hollow sections. That is, because the high tensile strength of a steel section as an outer confinement and the compressive strength of the concrete together enable slim and high-strength columns. As a result, they have been predominantly used as solitary supports in large buildings having a "large modular grid", and have not found widespread use as a system component of a wall having a "small modular grid".

Drywall technology has established itself in non-load bearing wall construction because of a variable and simple structure and cost-saving processing. In addition to the physical barrier, classifiable sound and fire protection requirements are met with a designable configuration. Here, a studding of aligned thin-walled steel lightweight sections each having flat locating surfaces is planked cross-supporting with predominantly gypsum plasterboard. Because of the low stability, in particular because of the thin-walled steel section supports of only about 0.6 mm thickness, this wall system is not suitable as a structural load-bearing wall for residential buildings. The small material thickness of the steel sections is due to the manual introduction of simple joining means.

The technologies used, the type and number of building materials, their processing and the qualifications of the personnel are important for success in a time- and cost-optimized construction process. In particular, the separation of the individual construction trades accelerates the process and creates cost certainty. Workers skilled in the field of concrete can create a shell house having concrete composite columns, while later the finishing trades secure their respective drywall or installation system to the structural construction. This construction process offers sufficient potential for savings, which are presented here.

Wall construction systems made of insulating blocks with integrated concrete supports and joining concrete beams are known from EP 2 360 321 A2 and DE 10 2005 026 797 A1. In the latter, a steel section embedded in concrete in the support with fold-out metal strips is used for joining to a later inner wall.

JP 2012-140824 A shows a composite column as a steel hollow section having inner ribs. The inner ribs surrounded by the concrete primarily improve the composite effect in the support, in addition to the stability of the formwork.

FR 900.328 A introduces a wall construction system having composite columns arranged in the modular grid as permanent formwork for load-bearing walls, in which concrete-filled steel hollow sections having all-round openings anchor the in-filling wall element in a structural interlocking manner. The position assignment between wall element and support is secured by the geometry of the hollow support as a whole. The openings in the hollow section of the support serve the concrete passage in the grooves of the wall element; a composite securing is of course given, but is not mentioned. A drywall planking is not intended.

WO 02/50383 A1 shows a concrete surface structure having composite beams, lightweight concrete in-fill and possible cover layers. To secure joining between the heavy concrete of the girder and the lightweight concrete of the in-fill, sheet openings are provided as grouting elements, namely called gill punching. Drywall construction building boards cannot be secured to it.

DE 4343 465 A1 shows a lightweight construction system made of thin-walled steel sections, which engage in insulating materials and can also serve as permanent formwork. A building board assembly thereon is not possible and not provided.

DE 816 143 B shows a detachable inner lining in the form of building boards on ceiling construction arranged in the modular grid made of lightweight steel sections in concrete composite construction. The building boards are secured to the steel section via intermediate links, here also detachable. Intermediate links are conventionally commonly used when lightweight construction is secured to structurally stable steel structures.

WO 2014/005162 introduces a wall-building system in which a plurality of floor-high wall-shaped body members are arranged in a form-fitting and wall-forming manner, wherein each wall body has a reinforced concrete rib which is enclosed on three sides by a "rib former". The recess in the lying wall body forms the lost formwork for concreting on the construction site. After hardening and assembly, the wall is plastered on both sides. A sheet metal reinforcement is not used here.

Generally known in the construction trade is the processing of gypsum plasterboard in structurally non-load bearing drywall stud walls with standardized sheet steel sections and their processing techniques.

Simple composite constructions in the form of a concrete-filled steel section have low fire resistance due to the direct fire exposure of the steel section, which requires additional measures, in particular in residential buildings. The supporting structure must be decoupled from the fire zone and structurally protected.

Walls with composite columns and simple in-fills arranged in the modular grid are inexpensive as a lightweight construction in the form of a skeleton construction, but, due to the low mass and the insufficiently absorbent layers, offer only little sound insulation, which was incompatible for use in residential construction.

For effective sound insulation, a spatial distance between the composite column and wall planking is imperative in order to use the air space or insertable damper as a sound absorber.

An extensive functional integration is important for an economical construction. The function of the wall, and simultaneously as a stiffening pane to support the structure of the house, is currently not compliant with sheet steel plasterboard drywall, because the thin drywall sections are too elastic and the wall connection is too difficult.

Thin-walled sheet steel sections having approximately 0.6 mm sheet metal thickness with flat locating surfaces are required if standardized and simple drywall technologies with gypsum plaster boards and manual processing are to be possible on the structurally stable composite columns.

However, with concrete-filled composite columns with thin sheet metal thicknesses, there is the further problem that no adhesive bond and thus no composite effect is provided between the sheet metal formwork and the concrete core because the thin sheet deforms and detaches from the concrete surface of the column under structural and thermal load. The usual thick material cross-sections of the steel sections of the composite columns guarantee the composite effect, but are not to be assembled manually due to their large mass and structurally not necessary for smaller homes and smaller modular grid spacing.

SUMMARY

Against this background, the invention has set itself the task of creating lightweight sheet steel sections to be manually processed for a composite construction, which combines concrete composite construction with drywall technology and eliminates or solves the above problems. The individual construction trades are to act completely separately and the dry finishing can be done at any time after the structural work and the wall installations. Simultaneously, the construction costs should be reduced by the elimination of components and processing steps and the structural connection of in-filling wall elements are made possible without additional assemblies.

The wall construction system disclosed in this paper achieves these objects. It uses a steel section which includes at least two functional portions as parts of a drywall composite column. One the one hand, a portion of the steel section is anchored in concrete and reinforcing the same. That portion, possibly also with other reinforcements, substantially carries the structural loads of the column or the house. On the other hand, there is a section portion without concrete contact that includes aligned drywall locating surfaces on at least a wall plane that are suitable for technologically simple manual planking with building boards. Both portions together fulfill the structural task of the column or wall.

One feature of the innovation is the combination of thin-walled sheet metal reinforcement of the concrete composite column with the thin-walled drywall locating surface. In this case, at least one story-high sheet steel section having a spatial inner locating surface protrudes out of the concrete composite column, which sheet steel section is suitable for an even wall planking according to drywall technology and which can be planked with building boards at any time even after concreting the concrete composite column. This portion of the steel section, here called sheet steel section, has material thicknesses of about 0.6 to 0.7 mm and at least one drywall locating surface. The immediate back side of this locating surface has a free space, or space filled with lightweight materials, for receiving joining means.

The entire steel composite section is, in the simplest case, formed of an equally thick sheet metal strip made of thin sheet steel with the two strip portions sheet steel section and sheet metal reinforcement, the latter preferably being a closed hollow section. Due to the concrete confinement and the continuous interlocking composite anchors on the sheet metal section, even these filigree profiles can fully incorporate their steel cross-section into the column load capacity. By varying the steel composite section in terms of internal geometry, material thickness and material or by setting profiles or by varying the quality of the concrete, the compressive strength of drywall composite column can be adapted to the loads without affecting external geometrical connection dimensions.

To increase the load capacity, the sheet metal reinforcements can be folded meandering or multi-layered in order to increase the steel content of the thin sheet in the particularly loaded zones. Or longitudinally welded sheet metal strips are used as semi-finished products for roll forming in profile manufacture, which consist of different sheet steel thicknesses and possibly steel grades, as theoretically known as Tailor Rolled Coil or Tailor Welded Coil, but are practically not available.

For example, the longitudinally welded sheet metal strip can have a sheet metal thickness of 0.6 mm for the portion of drywall locating surface and 1.6 mm sheet metal thickness with particularly high yield strength for the strip portion of the sheet metal reinforcement.

Manufacturing in a sheet metal strip is technologically difficult for larger sheet metal thickness differences of the two profile sections. Here, the separately manufactured profile sheets are later welded together off-site or joined manually at the construction site. In this case, the steel section parts engage in an interlocking manner in a rail-like manner or in an interlocking manner by means of local projections or are hooked or clipped together or attached in an interlocking manner, so that a rigid joining is created. The joining structure should lie in the concrete-contacted column region in order to simultaneously improve the composite effect. It is possible to combine a plurality of steel composite section variants with the same joining structure.

Noise and fire protection requirements are particularly important for lightweight exterior walls in residential construction. The load-bearing concrete composite column is effectively protected against fire load due to the complete planking of the wall with fire-resistant building boards, its anchoring to a non-combustible substructure and due to the spatial distance and the associated decoupling of the component layers.

Good soundproofing also requires as many as possible decoupled swinging planes with resonance buffers. The elastic design of the sheet steel section between building board planking and concrete composite column permits an effective damping structure and the distance or gap deliberately created by the sheet steel section provides an effective sound absorber, in particular in residential construction.

The sound insulation is further improved by means of uncoupled free oscillating mass through an elastic anchoring of an optional further building board (as an intermediate plate within the wall structure). In assembly, this structure is achieved most easily by enclosing an in-filling insulating block between the drywall composite columns, which is additionally almost completely factory-clad with an inner building board, which, however, does not itself touch the connection constructions.

House installations of any kind can also be laid out and secured in this gap and are possibly also again accessible or expandable.

The direct building board connection to the load-bearing concrete composite column permits a structural surface structure effect of the wall planking, which contributes to the bracing of the building.

Trade separation: The house wall can be structurally fully completed by means of composite columns and integrated wall elements in a short time in the construction process as a shell and is thereby simultaneously prepared for the drywall. The inner wall planking or the facade assembly can be done at any later time without interfering with other trades.

Composite effect: In the drywall composite column an interlocking and sharp-edged mutual engagement of steel and concrete by various sheet steel anchors takes place in the concrete-filled portion of the composite column transverse to the longitudinal axis over the entire profile length and profile surface, which prevent retraction of the sheet metal reinforcement from the concrete surface. Sheet steel anchors are either a) openings easily penetrable by the flowable concrete having passages at the sheet edges or b) local openings having a bent flag-like sheet metal section as an anchor or c) deforming local punches in the sheet metal surface as interlocking anchors (for example, bridges or stamping).

Freestanding drywall composite columns without lateral wall elements require a concrete-tight closed formwork. The sheet metal reinforcement punched for the composite effect or doweling can thus only be punched offset to the sheet metal thickness, which is thus feasible in round columns having good confinement. But if, for example, rectangular cross-sections are used as enveloping sheet metal reinforcements, each with straight flanks, an interlocking intensive doweling is thus required because of the low confinement effect in order to contain the enveloping section in the structural concrete composite. The necessary doweling is achieved by means of a plurality of local inwardly bent flag-like metal surfaces or high-curved bridges. The formwork is tightly wrapped, for example, with a film to prevent the concrete from escaping from the opened sheet metal formwork.

If in-filling wall elements are used, they thus determine the width of the modular grid or the distance of the columns and form the concrete formwork for the column. The wall elements themselves have vertically arranged lateral recesses with geometric undercuts, in which the drywall composite columns engage locking in an interlocking manner with the steel and/or concrete part. The concrete composite column itself in this case is either a concrete-filled hollow section made of sheet steel or an open steel section enclosed by the wall element with interlocking concrete teeth. After concrete grouting, there is then a structural load-bearing closed wall with the possibility for later planking with building boards.

If local structural fasteners are required by the nature of the facade covering, then these facade anchors are already preassembled or inserted in an interlocking manner in advance on the sheet steel section as a screw base or as a bar or facade support strips and only then the concrete grouting of the column takes place.

Diagonal bracing to brace the wall is possible between adjacent drywall composite columns in the wall plane depending on the need, which is screwed either in the assembly process directly to the sheet metal reinforcement or the foot profile (immediately adjacent to the column) or is inserted as a pull rod on breakable openings in advance dry in the sheet metal reinforcement and then grouted.

An important point in the application of drywall composite columns is the structural proof of the load-bearing capacity. The structural certainty of composite concrete columns actually in the steel-concrete functional connection allows a recognized design of construction and saves time-consuming single tests of multiply or nested very thin-walled sheet steel sections. Due to the risk of buckling, general calculation rules of steel construction require minimum wall thicknesses of the profile of 1.0 mm, whereby different sheet metal thicknesses are recommended in a drywall composite column.

Advantages: The wall construction system with drywall composite columns can be used both with and without in-filling wall elements, simplifying the shell and reducing the cost of construction. Two fitters can create structurally stable house walls in a short amount of time with minimal use of materials, with the required building physics and with just a few work steps. The trades can work unaffected and independently on shell construction, installations, window construction, drywall and facade construction. The wall construction system is modular variable and favors an open interior design due to the skeleton construction and the simple variation of the drywall composite columns and the in-filling wall elements.

DETAILED DESCRIPTION

Figure 1:
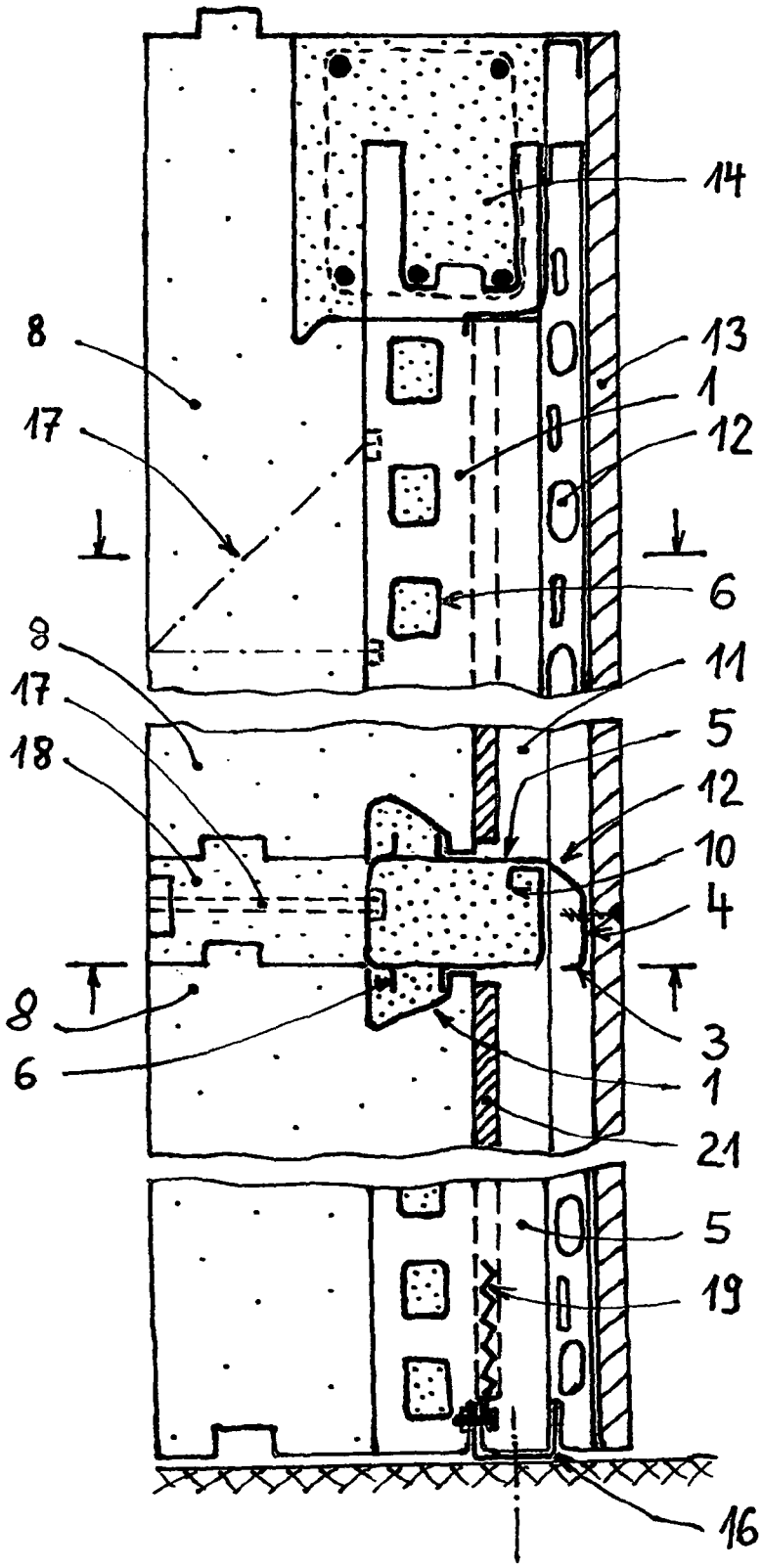
FIG. 1 shows portions of a vertical and horizontal cross-section through a house exterior wall.

FIG. 1 shows portions of a vertical and horizontal cross-section through a house exterior wall having a story-high drywall composite column (1) and in-filling wall elements (8). The drywall composite column (1) is set in a rail-like manner in a foot profile (16) anchored to the construction and axially secured thereto with a concrete connection anchor (19).

The in-filling wall elements (8) in the form of dimensionally stable story-high insulation panels made of rigid foam have on both sides continuous lateral recesses as a permanent formwork (15) for receiving the sheet metal reinforcement (5) and the grouting concrete (23). At the column head, the sheet metal formwork (5) engages in a concrete beam (14) in order to achieve a structural clamping of the concrete composite column (2) to reduce the tendency to buckling.

The drywall composite column (1) component includes two portions. A first portion is a concrete composite column (2) with an integrated sheet metal reinforcement (5) and grouting concrete (23). A second portion without concrete contact has a sheet steel section (3) and an integrated drywall locating surface (4). The columns aligned in the wall plane are planked on their respective drywall locating surfaces (4), predominantly with gypsum building boards (13) with joining means.

The sheet metal reinforcement (5) of the concrete composite column (2) and the sheet steel section (3) with the drywall locating surface (4) are manufactured from the same galvanized Tailor Welded Coil as a sheet metal strip semi-finished product by roll forming, the sheet metal portions of which, however, have different thicknesses and qualities. The sheet metal reinforcement (5) is a welded rectangular hollow section of approx. 80×125 mm having a wall thickness of 1.6 mm and a yield strength of approx. 600 N/mm2. The projecting sheet steel section (3) having the flat drywall locating surface (4) has a sheet metal thickness of only 0.6 mm and a yield strength of about 300 N/mm2.

A free space of about 30 mm is available behind the locating surface (4) to receive joining means and installations. The sheet steel section (3) has punched out lateral openings (12) for horizontal routing of cables and lines of the house and to improve its elasticity. This profile flank is also manufactured at an angle of approx. 45° in order to couple the planking with even more elastically with regard to sound technology.

The hollow section of the sheet metal reinforcement (5) has, over the entire length, continuous flag-like sheet metal bends (6) with corresponding openings in the profile, which can be well penetrated by the flowable concrete. These flag-like sheet metal bends (6) hold the sheet metal reinforcement (5) in an interlocking and positionally accurate manner in the in-filling wall elements (8) in the assembly process and serve to secure composite steel and concrete. The inner rib (10) with toothed strip also serves this functional connection.

The structural loads of the in-filling wall elements can be absorbed and transmitted to the column with a dimensionable depth of engagement of the concrete in the lateral recesses.

Depending on the stability and sound insulation requirements, the lightweight wall elements (8) can be additionally laminated on the inner side over the entire surface or only at the edges with an intermediate plate (21), as shown here. The intermediate plate (21) should be about 5 mm smaller so that, as an elastic vibration system, it also significantly improves the soundproofing of the lightweight wall, so that direct contact with the drywall composite column (1) is excluded.

Depending on the stress on the facade and the stability of the wall element, additional constructive supports can be required as point facade anchors (17) or facade support strips (18) which are anchored directly to the drywall composite column (1) and are already secured to the sheet metal reinforcement (5) during assembly and structurally prior to concrete grouting.

FIG. 2 shows further embodiments of drywall composite columns made of a thin-walled sheet steel strip having the same thickness for the two portions.

Figure 2A:
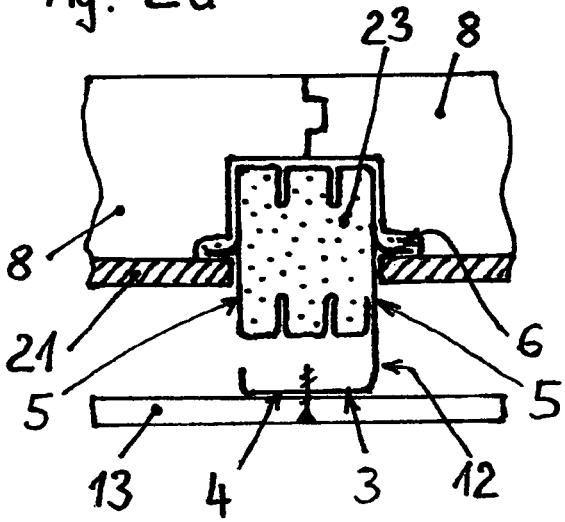
FIGS. 2*a*, 2*b*, 2*c*, and 2*d* show horizontal cross-sections through alternative embodiments of drywall composite columns.

FIG. 2*a* shows a wall cross-section having wall elements (8) and intermediate plates (21) adhered to the inside over the entire surface, for example, as cement composite panels. The sheet metal reinforcement (5) is anchored in the assembly process by a plurality of flag-like sheet metal bends (6) interlocking to the wall elements and intermediate plates in the undercut lateral recesses.

By grouting the column, the concrete penetrates through the profile openings into the wall element (8) and also acts on the narrow side flanks of the intermediate plates (21) and thus clamps these in a pressure-resistant manner between the drywall composite columns (1) arranged in the modular grid. The intermediate plates (21) are also acted upon from above by the concrete of the beam. Thus, the bracing of the wall and the profile stiffening of the weak axis is guaranteed against buckling without further assembly steps, also improving the sound and fire protection of the wall.

The sheet metal reinforcement (5) is manufactured as a hollow section with protruding drywall locating surface (4) made of a sheet metal strip of equal thickness by roll forming and has meandering folded material concentrations for structural reinforcement, which improve the carrying capacity of the column and the steel concrete functional connection as blocked and somewhat compressed ribs.

Figure 2C:
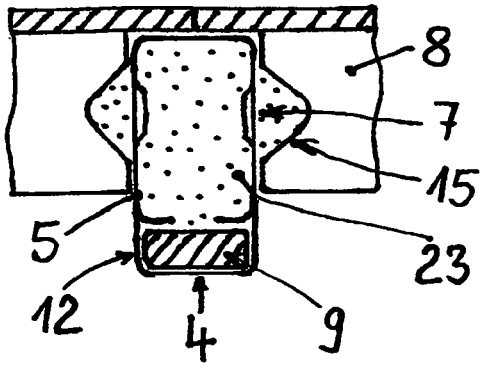
Figure 2B:
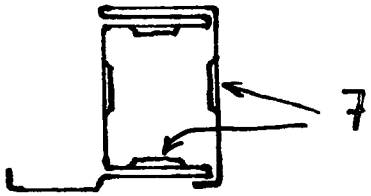

FIG. 2*b* shows only the cross-section of a composite sheet of drywall composite column (1) made of thin-walled folded sheet metal reinforcement with all-round continuous openings and sheet steel anchors (7) in the form of bent sheet metal lips (passages) on the sheet openings to secure the interlocking functional connection over the entire profile length. The material concentration of the sheet is adapted to the load.

In FIG. 2*c*, the sheet steel section (3) and the sheet metal reinforcement (5) of the drywall composite column is manufactured from the same sheet metal strip of 0.7 mm thick galvanized sheet steel. The spatial distance of the drywall locating surface (4) to the surface of the column concrete is achieved by an interlocking inserted volume stable lightweight material backfill (9). Even after the concrete filling, this lightweight material (9) can be penetrated by joining means and can also be broken through by installations through the lateral installation openings (12). The functional connection with the concrete is achieved by sheet steel anchors (7) in the form of a plurality of openings with passages. The lateral recesses secure the wall elements (8) to the concrete grouting on the concrete composite column and prevent detachment of the enclosing sheet steel reinforcement from the column concrete.

Figure 2D:
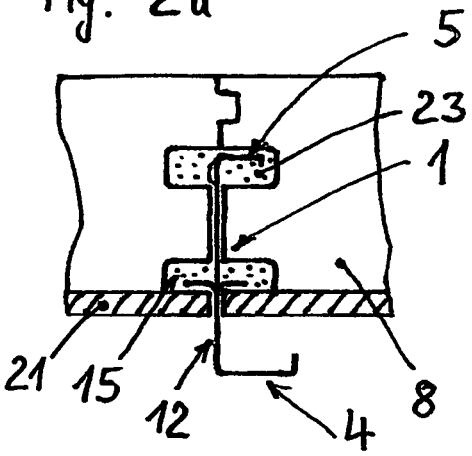

FIG. 2*d* shows the cross-section of in-filling wall elements (8) of a drywall composite column (1) and a simple sheet metal reinforcement (5) in conjunction with high-strength concrete as a spread concrete composite column. Continuous openings are included as sheet steel anchors (7) in the sheet metal reinforcement (5) in both concrete zones and also flag-like sheet metal bends (6) for assembly locking. The wall element is the sole formwork for the grouting concrete (23) of the concrete composite column.

Figure 3A:
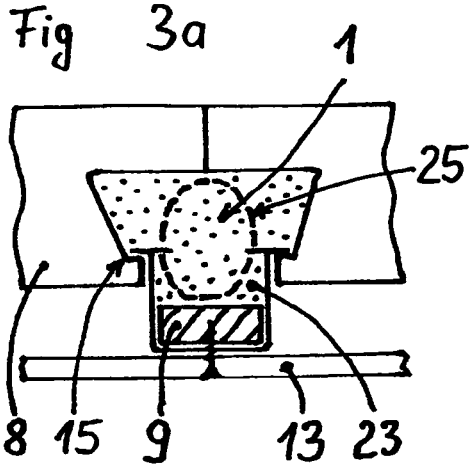
FIGS. 3*a* and 3*b* show horizontal cross-sections through further alternative embodiments of drywall composite columns.

FIG. 3*a*: Sheet steel section (3) and sheet metal reinforcement (5) are manufactured from the same thin-walled sheet metal strip semi-finished product. The sheet metal reinforcement (5) is over mutually bent flanks interlocking with the wall elements (8) as formwork and with a coarse mesh tubular fabric mesh (25). The coarse fabric consists of longitudinally reinforced carbon fibers, which can be penetrated well by the flowable concrete. The fabric mesh hose can be produced easily and in a load-adapted manner in many dimensions and without tooling costs, can be processed and assembled on site and is insensitive in corrosive environment. The lightweight material backfill (9) includes the spatial distance between drywall locating surface (4) and concrete surface.

Figure 3B:
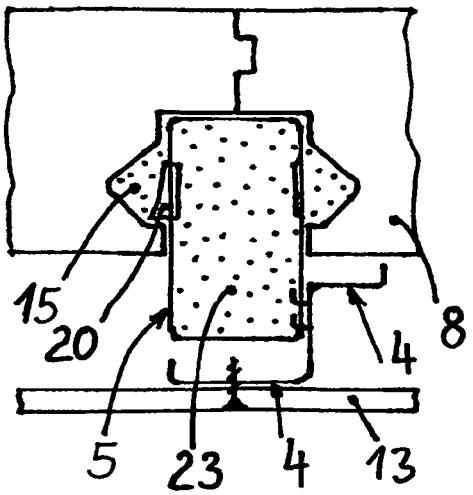

FIG. 3*b* shows a rectangular hollow section having 2 mm sheet metal thickness as a sheet metal reinforcement (5) having a plurality of local sheet steel anchors (7) in the form of openings with passages and a sheet steel section (3) with 0.6 mm sheet metal thickness having an outer drywall locating surface (4) and an inner wall drywall locating surface (4). The sheet steel section (3) is inserted in an interlocking manner into punched holes in the sheet metal reinforcement (5) in a precise position and permanently locked by the subsequent concrete grouting. The inner wall drywall locating surface (4) is used for additional planking with building boards (13) for structural stiffening of the wall or/and for improving sound and fire protection.

To secure the position of the external "smooth" hollow section during assembly, separate small molded parts are inserted as a profile holder (20) in a few lateral openings, which molded parts hold the sheet metal reinforcement (5) in the undercut of the wall element (8) in an interlocking manner (tongue and groove principle). After grouting, the concrete interlocking bears weight.

FIG. 4 shows a plurality of cross-sections of freestanding composite columns without in-filling wall element, as they are predominantly used in load-bearing inner walls.

Figure 4A:
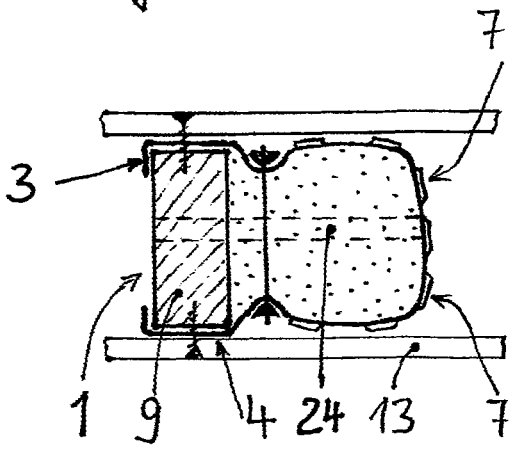
FIGS. 4*a*-4*d* show cross-sections through freestanding composite columns.

FIG. 4*a* shows a drywall composite column (1) having a predominantly rectangular concrete cross-section and having arched envelope surfaces from 3-sided enclosing sheet metal reinforcement and two sheet steel section portions having drywall locating surfaces (4), which are manufactured from a thin-walled sheet metal strip semi-finished product having the same material thickness. On a side of the column, a dimensionally stable lightweight material backfill (9) is inserted, which closes off the column as formwork and simultaneously forms the free space for fastening connections behind the drywall locating surfaces (4). The profile legs are held together by means of a plurality of U-bolts on the column height.

The composite effect is ensured, in addition to the U-bolts, primarily over several rows of sheet steel anchors (7) in the form of "bridges" as reshaping partial punching over the entire length or height of the column. The bridges are punched horizontally, so that the sharp-edged sheet bends allow for the stresses along the steel section anchor function on the concrete surface. If the bending out is only slightly more than the material thickness of the sheet steel, then the function as a concrete-tight formwork is still preserved.

In the case of higher sheet-metal bridges, for example, an externally spreadable covering is necessary as a hardening thick coating (22) to ensure a sealed formwork in order to close the gaps in the sheet metal.

For house installations, a cladding tube (24) has been inserted in the precisely prepared openings of the composite section before the concrete grouting. For this purpose, a plurality of openings is pre-punched on the sheet metal section, which can be broken off as required.

Figure 4B:
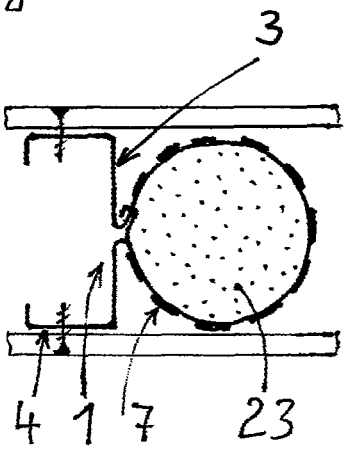

FIG. 4*b* shows a column having a round concrete cross-section having two drywall locating surfaces (4) and having a plurality of sheet steel anchors (7) in the form of inner sharp-edged stamping over the entire column height to ensure the concrete composite. The sheet metal formwork cannot detach from the surface due to the strained confinement of the concrete core. Many individual sheet metal tabs engage in perforations of the opposite side at the central contact point of the sheet metal reinforcement (5) and are hooked by bending in such a way that a quasi-structurally stable tube is produced.

Figure 4C:
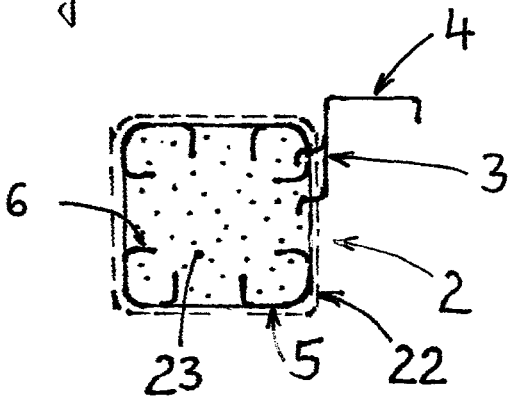

For the functional connection, the embodiment FIG. 4*c* has continuously flag-like sheet metal bends (6) inwards (horizontal or vertical) in several rows with corresponding openings in the envelope surface of the sheet metal reinforcement (5). The bends have the shape of a trapezoidal surface and are anchored by the longer inner side in an interlocking manner and by the two-sided adhesive bond and in a force-fitting manner in the concrete of the column. Film or fabric (22) is wrapped tightly, around the circumference so that the concrete cannot escape through the openings in the formwork of the concrete composite column (2). At least one sheet steel section (3) having at least one drywall locating surface (4) is hooked or joined in an interlocking manner in precisely fitting openings through the film envelope. A position of the drywall locating surface (4) is adjustable before the respective drywall composite column is filled with concrete.

Local incisions for selectively bendable or breakable profile zones can be present on the sheet metal reinforcement (5) of the concrete composite column (2) in order to be able to put diagonal braces or struts into the formwork from the outside. Likewise, flag-like sheet metal bends (6) can exist inward to firmly damp setting profiles precisely in position.

Figure 4D:
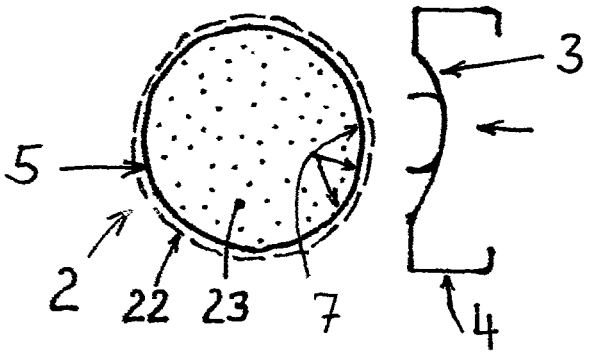

FIG. 4*d*: The cross-section of the concrete composite column (2) shows a perforated steel tube having 1.5 mm sheet metal thickness and having a dense film wrapping (22). The perforations in the sheet metal reinforcement of about 30 mm in diameter are, in this case, sufficiently large to act as a sheet steel anchor (7).

One or more thin-walled sheet steel sections (3) having 0.6 mm sheet metal thickness and flat bearing surface (4) are inserted or hooked on the concrete composite column (2) in an interlocking manner later on the site through the film by means of sharp and precisely fitting bends in the perforations and permanently joined by the later concrete grouting.

LIST OF REFERENCE NUMBERS

1 drywall composite column
2 concrete composite column
3 sheet steel section
4 drywall locating surface
5 sheet metal reinforcement
6 flag-like sheet metal bend
7 sheet steel anchors
8 wall element
9 lightweight material backfill
10 rib
11 gap
12 installation openings
13 building boards
14 concrete beam
15 permanent formwork
16 foot profile
17 facade anchors
18 facade support strips
19 concrete connection anchor
20 profile holder
21 intermediate plate
22 wrapping with film
21 concrete
24 cladding tube for installations
25 fabric mesh

The invention claimed is:

1. A system for constructing load-bearing walls, comprising:

a plurality of story-high drywall composite columns which support ceilings and walls of a house, the drywall composite columns being arranged in a modular grid; and building boards planking at least one side of the drywall composite columns, wherein each of the drywall composite columns includes a first portion including a concrete composite column (2) with a sheet metal reinforcement (5) and a second portion which is spatially offset from the first portion and includes at least one thin-walled sheet steel section (3) having a flat drywall locating surface (4), wherein the sheet steel section (3) is connected to and extends parallel to the concrete composite column (2), and wherein the flat drywall locating surface (4) is arranged at a distance from the concrete composite column, and wherein the flat drywall locating surfaces of the drywall composite columns are arranged in a common plane which does not intersect the concrete composite columns, and wherein the building boards (9) are secured to the flat drywall locating surfaces of two or more adjacent ones of the drywall composite columns.

2. The system as in claim 1, further comprising installation openings (6) arranged in the sheet steel section (3) between the concrete composite column (2) and drywall locating surface (4).

3. The system as in claim 1, wherein the sheet metal reinforcement (5) the concrete composite column (2) and the corresponding sheet steel section (3) having the drywall locating surface (4) are manufactured from a single piece sheet metal strip semi-finished product.

4. The system as in claim 3, wherein the sheet metal strip semi-finished product has a uniform thickness and wherein the sheet metal reinforcement (5) has at least one local material concentration in form of meandering or multi-layered sheet metal folds.

5. The system as in claim 3, wherein the single piece sheet metal strip semi-finished product has different material thicknesses and/or different material qualities in the first portion and the second portion.

6. The system as in claim 1, wherein the sheet metal reinforcement (5) of the concrete composite column (2) has local sheet metal bends (6) over its entire length or height, which a) are suitable for their own positional fixation on a component or b) engage in an interlocking manner in wall elements (8) or c) anchor a tubular sheathing plate in the concrete or d) fix a position of additional setting profiles.

7. The system as in claim 1, wherein the sheet metal reinforcement (5) of the concrete composite column (2) is tubular and has local sheet metal bends in the form of punched material offsets on its entire length or height, through which concrete cannot pass.

8. The system as in claim 1, wherein the sheet metal reinforcement (5) of the concrete composite column (2) comprise expanded metal, wire mesh, or fiber fabric mesh (25) and is joined to the sheet steel section (3) or is engaged with the sheet steel section by concrete.

9. The system as in claim 1, wherein the sheet steel section (3) and the sheet metal reinforcement (5) of the concrete composite column (2) are separate story-high parts which are joined together by interlocking joining structures.

10. The system as in claim 9, wherein the sheet steel section (3) and the sheet metal reinforcement (5) have different material thicknesses and/or different material qualities.

11. The system as in claim 1, wherein a position of the drywall locating surface (4) is adjustable before the respective drywall composite column is filled with concrete.

12. The system as in claim 1, wherein at least one further drywall locating surface (4) is present within a wall between the drywall composite columns (1), a further flat locating surface of which is offset parallel to the common plane.

13. The system as in claim 1, wherein an outer peripheral surface of the sheet metal reinforcement (5) of the concrete composite column (2) is completely or partially sealingly enclosed with film (22) or fabric or a thick coating.

14. The system as in claim 1, wherein directly between adjacent ones of the drywall composite columns (1) an in-filling wall element (8) is inserted, the in-filling wall element comprising a factory-laminated building board covering at least one side thereof at least partially.

15. The system as in claim 14, wherein the building board (21) is slightly smaller in area than the wall element and does not contact the drywall composite columns (1).

* * * * *